US008197998B2

(12) United States Patent
Zhou et al.

(10) Patent No.: US 8,197,998 B2
(45) Date of Patent: Jun. 12, 2012

(54) TONER COMPOSITIONS

(75) Inventors: Ke Zhou, Oakville (CA); Maria N. V. McDougall, Oakville (CA); Karen A. Moffat, Brantford (CA); Richard P. N. Veregin, Mississauga (CA); Enno E. Agur, Toronto (CA)

(73) Assignee: Xerox Corporation, Norwalk, CT (US)

( * ) Notice: Subject to any disclaimer, the term of this patent is extended or adjusted under 35 U.S.C. 154(b) by 572 days.

(21) Appl. No.: 12/469,125

(22) Filed: May 20, 2009

(65) Prior Publication Data

US 2010/0297546 A1 Nov. 25, 2010

(51) Int. Cl.
*G03G 9/08* (2006.01)

(52) U.S. Cl. ..... 430/110.1; 430/110.2

(58) Field of Classification Search ..... 430/110.1, 430/110.2

See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 5,346,797 | A | 9/1994 | Kmiecik-Lawrynowicz et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,063,827 | A | 5/2000 | Sacripante et al. |
| 6,165,668 | A | 12/2000 | Wilson et al. |
| 6,184,387 | B1 | 2/2001 | Wilson et al. |
| 6,197,467 | B1 | 3/2001 | Yamanaka et al. |
| 6,207,335 | B1 | 3/2001 | Michel et al. |

(Continued)

FOREIGN PATENT DOCUMENTS

WO WO2008/072925 A1 6/2008

OTHER PUBLICATIONS

U.S. Appl. No. 12/032,173, filed Dec. 15, 2008 entitled "Solvent-Free Phase Inversion Process for Producing Resin Emulsions".

*Primary Examiner* — Hoa V Le
(74) *Attorney, Agent, or Firm* — Judith L. Byorick

(57) ABSTRACT

Toner particles are provided which may, in embodiments, include a core and a shell. In embodiments, charge control agents may be co-emulsified with a resin utilized to form a shell. The shell may prevent a crystalline resin in the core from migrating to the toner surface. Inclusion of the charge control agent in the shell itself may provide the resulting toner particles with desirable charge characteristics and sensitivity to relative humidity.

20 Claims, 3 Drawing Sheets

U.S. PATENT DOCUMENTS

| | | | | |
|---|---|---|---|---|
| 6,214,507 | B1 | 4/2001 | Sokol et al. | |
| 6,326,113 | B1 | 12/2001 | Okuda et al. | |
| 6,593,049 | B1 | 7/2003 | Veregin et al. | |
| 6,756,176 | B2 | 6/2004 | Stegamat et al. | |
| 6,762,004 | B2 | 7/2004 | Yamanaka et al. | |
| 6,790,577 | B1 * | 9/2004 | Nakamura | 430/109.3 |
| 6,830,859 | B2 | 12/2004 | Shiraishi et al. | |
| 6,830,860 | B2 | 12/2004 | Sacripante et al. | |
| 6,908,720 | B2 | 6/2005 | Kenmoku et al. | |
| 6,977,129 | B2 | 12/2005 | Saito et al. | |
| 7,029,817 | B2 | 4/2006 | Robinson et al. | |
| 7,214,463 | B2 | 5/2007 | Patel et al. | |
| 7,307,111 | B2 | 12/2007 | Moffat et al. | |
| 7,371,495 | B2 | 5/2008 | Sato | |
| 2003/0180642 | A1 | 9/2003 | Isoda et al. | |
| 2005/0208409 | A1 | 9/2005 | Yasumatsu et al. | |
| 2005/0287461 | A1 | 12/2005 | Sweeney et al. | |
| 2006/0188801 | A1 | 8/2006 | Guistina et al. | |
| 2006/0216625 | A1 | 9/2006 | Maehata et al. | |
| 2006/0216628 | A1 * | 9/2006 | Nakamura et al. | 430/110.2 |
| 2006/0222991 | A1 | 10/2006 | Sacripante et al. | |
| 2006/0251977 | A1 | 11/2006 | Kim | |
| 2006/0257776 | A1 | 11/2006 | Yasumatsu et al. | |
| 2006/0269858 | A1 | 11/2006 | McDougall et al. | |
| 2006/0292477 | A1 * | 12/2006 | Daimon et al. | 430/109.4 |
| 2007/0037086 | A1 | 2/2007 | Skorokhod et al. | |
| 2007/0099103 | A1 | 5/2007 | Guistina et al. | |
| 2007/0141494 | A1 | 6/2007 | Zhou et al. | |
| 2007/0207400 | A1 | 9/2007 | Ahuja et al. | |
| 2007/0224532 | A1 | 9/2007 | Vanbesien et al. | |
| 2007/0254229 | A1 | 11/2007 | Patel et al. | |
| 2007/0269730 | A1 | 11/2007 | Lee et al. | |

* cited by examiner

TONER COMPOSITIONS

BACKGROUND

The present disclosure relates to toners suitable for electrophotographic apparatuses.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Polyester EA ultra low melt (ULM) toners have been prepared utilizing amorphous and crystalline polyester resins. An issue which may arise with this formulation is that the crystalline polyester may migrate to the surface of the toner particle which, in turn, may adversely affect charging characteristics. Various processes/modifications have been suggested to avoid these issues. For example, the application of shells to the toner particles may be one way to minimize the migration of a crystalline polyester to the toner particle surface. In other cases, charge control agents (CCAs) may be utilized to increase the charge on toner particles. However, most CCAs are only available in solid powder form and need to be converted into aqueous dispersions for emulsion aggregation use. Thus, it can be very difficult, if not impossible, to use many of them efficiently. It thus remains desirable to improve the charging characteristics of EA toners possessing crystalline polyesters.

SUMMARY

The present disclosure provides toners and processes for preparing same. In embodiments, a process of the present disclosure may include contacting at least one amorphous resin with an optional crystalline resin in a dispersion form; contacting the dispersion with an optional colorant, at least one surfactant, and an optional wax to form small particles; aggregating the small particles to form a core; contacting the small particles with an emulsion including at least one charge control agent in combination with at least one amorphous resin to form a shell over the small particles; coalescing the small particles possessing the shell to form toner particles; and recovering the toner particles.

In embodiments, a process of the present disclosure may include contacting at least one amorphous resin with an optional crystalline resin in a dispersion; contacting the dispersion with an optional colorant, at least one surfactant, and an optional wax to form small particles; aggregating the small particles to form a core; contacting the small particles with an emulsion including at least one charge control agent in combination with at least one amorphous resin to form a shell over the small particles; coalescing the small particles possessing the shell to form toner particles; and recovering the toner particles, wherein the emulsion including the at least one charge control agent in combination with at least one polyester resin is prepared by a method such as solvent flash methods, phase inversion methods, and solvent less emulsification methods.

Toners of the present disclosure may include, in embodiments, a core including at least one amorphous resin, at least one crystalline resin, and one or more optional ingredients such as optional colorants, optional waxes, and combinations thereof; and a shell including at least one charge control agent such as alkyl pyridinium halides, bisulfates, organic sulfates, organic sulfonates, cetyl pyridinium tetrafluoroborates, distearyl dimethyl ammonium methyl sulfate, aluminum salts, zinc salts, azo-metal complexes, amorphous metal complex salt compounds, carboxylic acids, substituted carboxylic acids, metal complexes of carboxylic acids, nitroimidazole derivatives, calixarene compounds, sulfonates, styrene-acrylate-based copolymers with sulfonate groups, styrene-methacrylate-based copolymers with sulfonate groups, and combinations thereof, co-emulsified with at least one amorphous shell resin.

BRIEF DESCRIPTION OF THE DRAWINGS

Various embodiments of the present disclosure will be described herein below with reference to the figures wherein.

DETAILED DESCRIPTION

Figure 1:
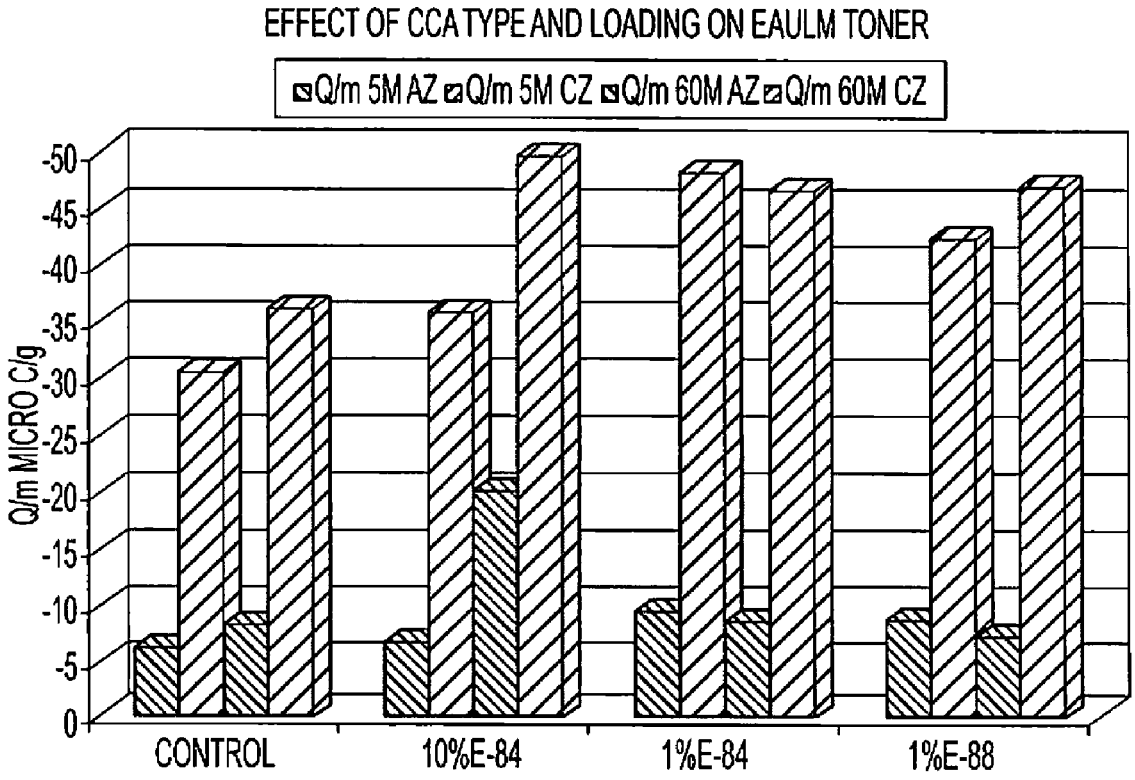
FIG. 1 is a graph comparing the charging (in both A-zone and C-zone) of toners of the present disclosure, possessing charge control agents in the shell, with a control toner.

The present disclosure provides toner particles having desirable charging properties. The toner particles possess a core-shell configuration, with a charge control agent (CCA) included in the shell.

In embodiments, a CCA may be included in the shell by co-emulsifying a CCA and amorphous shell resin to form a CCA/amorphous resin emulsion. In some embodiments, the CCA may be emulsified with the amorphous shell resin using a solvent flash or phase inversion method, followed by evaporating the solvent. Because most CCAs are organic compounds stabilized with counter ions, they may stay in the latex micelles which contain the amorphous resin. Thus, an amorphous shell emulsion containing CCAs can be prepared for emulsion aggregation use.

Core Resins

Any latex resin may be utilized in forming a toner core of the present disclosure. Such resins, in turn, may be made of any suitable monomer. Any monomer employed may be selected depending upon the particular polymer to be utilized.

In embodiments, the core resins may be an amorphous resin, a crystalline resin, and/or a combination thereof. In further embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly (5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly (pentylene-succinate), alkali copoly(5-sulfoisophthaloyl)-copoly(hexylene-succinate), alkali copoly(5-sulfoisophthaloyl)-copoly(octylene-succinate), alkali copoly (5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly (octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly (ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

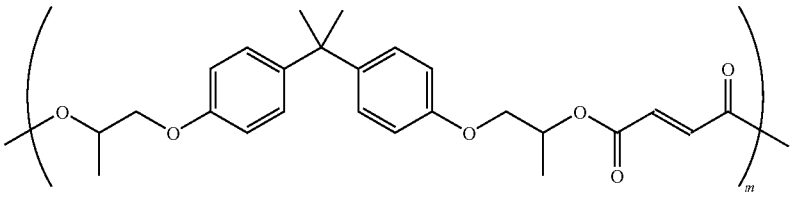

(I)

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally in combination with an amorphous resin as descried above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

(II)

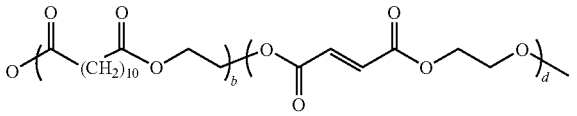

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a core.

In embodiments, the core resin may be a crosslinkable resin. A crosslinkable resin is a resin including a crosslinkable group or groups such as a C=C bond. The resin can be crosslinked, for example, through a free radical polymerization with an initiator. Thus, in embodiments, a resin utilized for forming the core may be partially crosslinked, which may be referred to, in embodiments, as a "partially crosslinked polyester resin" or a "polyester gel". In embodiments, from about 1% by weight to about 50% by weight of the polyester gel may be crosslinked, in embodiments from about 5% by weight to about 35% by weight of the polyester gel may be crosslinked.

In embodiments, the amorphous resins described above may be partially crosslinked to form a core. For example, an amorphous resin which may be crosslinked and used in forming a toner particle in accordance with the present disclosure may include a crosslinked amorphous polyester of formula I above. Methods for forming the polyester gel include those within the purview of those skilled in the art. For example, crosslinking may be achieved by combining an amorphous resin with a crosslinker, sometimes referred to herein, in embodiments, as an initiator. Examples of suitable crosslinkers include, but are not limited to, for example, free radical or thermal initiators such as organic peroxides and azo compounds. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy)diisopropyl benzene, di-t-butyl peroxide and 2,5-dimethyl 2,5-di (t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2di(t-butyl peroxy)butane, ethyl 3,3-di(t-butyl peroxy)butyrate and ethyl 3,3-di(t-amyl peroxy)butyrate, and combinations thereof. Examples of suitable azo compounds include 2,2'-azobis(2,4-dimethylpentane nitrile), azobis-isobutyronitrile, 2,2'-azobis (isobutyronitrile), 2,2'-azobis(2,4-dimethyl valeronitrile), 2,2'-azobis (methyl butyronitrile), 1,1'-azobis(cyano cyclohexane), other similar known compounds, and combinations thereof.

Although any suitable initiator can be used, in embodiments the initiator may be an organic initiator that is soluble in any solvent present, but not soluble in water. For example, half-life/temperature characteristic plots for VAZO® 52 (2,2'-azobis(2,4-dimethylpentane nitrile), commercially available from E. I. du Pont de Nemours and Company, USA) shows a half-life greater than about 90 minutes at about 65° C. and less than about 20 minutes at about 80° C.

Where utilized, the initiator may be present in an amount of from about 0.5% by weight to about 20% by weight of the resin, in embodiments from about 1% by weight to about 10% by weight of the resin.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 40° C. to about 95° C., for a period of time of from about 1 minute to about 10 hours, in embodiments from about 5 minutes to about 5 hours, to form a crosslinked polyester resin or polyester gel suitable for use in forming toner particles.

In embodiments, the resins utilized in the core may have a glass transition temperature of from about 30° C. to about 80° C., in embodiments from about 35° C. to about 70° C. In further embodiments, the resins utilized in the core may have a melt viscosity of from about 10 to about 1,000,000 Pa*S at about 130° C., in embodiments from about 20 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion polymerization methods.

Toner

The resin described above may be utilized to form toner compositions. Such toner compositions may include optional colorants, waxes, and other additives. Toners may be formed utilizing any method within the purview of those skilled in the art.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUET™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK ET from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and subsequent coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles. In accordance with the present disclosure, a charge control agent (CCA) may be incorporated into the toner shell by adding the CCA to an emulsion including the resin utilized to form the shell. Addition of the CCA to the emulsion resin provides uniform distribution of the CCA throughout the shell, and thus more uniform toner charging.

Resins which may be utilized to form the shell include, but are not limited to, the amorphous resins described above for use in the core. In embodiments, an amorphous resin which may be used to form a shell in accordance with the present disclosure may include an amorphous polyester of formula I above.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds described above as suitable for forming a gel in the core. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy)diisopropyl benzene, di-t-butyl peroxide and 2,5-dimethyl 2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy) butyrate and ethyl 3,3-di(t-amyl peroxy) butyrate, and combinations thereof. Examples of suitable azo compounds include 2,2'-azobis(2,4-dimethylpentane nitrile), azobis-isobutyronitrile, 2,2'-azobis(isobutyronitrile), 2,2'-azobis (2,4-dimethyl valeronitrile), 2,2'-azobis(methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time of from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, in embodiments, a first polyester resin may be combined with other resins to form a shell. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

Charge Control Agents

Any CCA may be utilized in the shell of a toner of the present disclosure. Exemplary CCAs include, but are not limited to, quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts and zinc salts, combinations thereof, and the like.

In embodiments, the resin utilized to form a toner may include an amorphous polyester in combination with a crystalline polyester. Although many of these toners may have excellent fusing performance, in some cases the toners may have poor charging performance. While not wishing to be bound by any theory, this poor charging performance may be due to the crystalline component migrating to the particle surface during the coalescence stage of EA particle formation.

Thus, in embodiments, it may be desirable to incorporate a charge control agent (CCA) into the toner formulation. CCAs may have a negative or positive charge. Suitable negative or positive CCAs may include, in embodiments, organic and/or organometallic complexes. For example, negative CCAs may include azo-metal complexes, for instance, VALIFAST® BLACK 3804, BONTRON® S-31, BONTRON® S-32, BONTRON® S-34, BONTRON® S-36, (commercially available from Orient Chemical Industries, Ltd.), T-77, AIZEN SPILON BLACK TRH (commercially available from Hodogaya Chemical Co., Ltd.); amorphous metal complex salt compounds with monoazo compounds as ligands, including amorphous iron complex salts having a monoazo compound as a ligand (see, for example, U.S. Pat. No. 6,197,467, the disclosure of which is hereby incorporated by reference in its entirety); azo-type metal complex salts including azo-type iron complexes (see, for example, U.S. Patent Application No. 2006/0257776, the disclosure of which is hereby incorporated by reference in its entirety); monoazo metal compounds (see, for example, U.S. Patent Application No. 2005/0208409, the disclosure of which is hereby incorporated by reference in its entirety); copper phthalocyanine complexes; carboxylic acids, substituted carboxylic acids and metal complexes of such acids; salicylic acid, substituted salicylic acid, and metal complexes of such acids, including 3,5-di-tert-butylsalicylic acid; metal complexes of alkyl derivatives of salicylic acid, for instance, BONTRON® E-81, BONTRON® E-82, BONTRON® E-84, BONTRON® E-85, BONTRON® E-88 (commercially available from Orient Chemical Industries, Ltd.); metal complexes of alkyl-aromatic carboxylic acids, including zirconium complexes of alkyl-aromatic carboxylic acids, such as 3,5-di-t-butylsalicylic acid (see, for example, U.S. Pat. No. 7,371,495, the disclosure of which is hereby incorporated by reference in its entirety); zinc compounds of alkylsalicylic acid derivatives including zinc compounds of 3,5-di-tert-butylsalicylic acid (see, for example, U.S. Patent Application No. 2003/0180642, the disclosure of which is hereby incorporated by reference in its entirety); salicylic acid compounds including metals and/or boron complexes including zinc dialkyl salicylic acid and/or boro bis(1,1-diphenyl-1-oxo-acetyl potassium salt) (see, for example, U.S. Patent Application No. 2006/0251977, the disclosure of which is hereby incorporated by reference in its entirety); naphthoic acids, substituted naphthoic acids and metal complexes of such acids, including zirconium complexes of 2-hydroxy-3-naphthoic acid (see, for example, U.S. Pat. No. 7,371,495, the disclosure of which is hereby incorporated by reference in its entirety); hydroxycarboxylic acids, substituted hydroxycarboxylic acids and metal complexes of such acids, including metal compounds having aromatic hydroxycarboxylic acids as ligands (see, for example, U.S. Pat. No. 6,326,113, the disclosure of which is hereby incorporated by reference in its entirety); dicarboxylic acids, substituted dicarboxylic acids, and metal complexes of such acids, including metal compounds having aromatic dicarboxylic acids as ligands (see, for example, U.S. Pat. No. 6,326,113, the disclosure of which is hereby incorporated by reference in its entirety); nitroimidazole derivatives; boron complexes of benzilic acid, including potassium borobisbenzylate, for instance LR-147 (commercially available from Japan Carlit Co., Ltd.); calixarene compounds, for instance BONTRON® E-89 and BONTRON® F-21 (commercially available from Orient Chemical Industries, Ltd.); metal compounds obtainable by reacting one, two, or more molecules of a compound having a phenolic hydroxy group, including calixresorcinarenes or derivatives thereof, and one, two, or more molecules of a metal alkoxide (see, for example, U.S. Pat. No. 6,762,004, the disclosure of which is hereby incorporated by reference in its entirety); metal carboxylates and sulfonates (see, for example, U.S. Pat. No. 6,207,335, the disclosure of which is hereby incorporated by reference in its entirety); organic and/or organometallic compounds containing sulfonates, including copolymers selected from styrene-acrylate-based copolymers and styrene-methacrylate-based copolymers with sulfonate groups (see, for example, U.S. Patent Application No. 2007/0269730, the disclosure of which is hereby incorporated by reference in its entirety); sulfone complexes including alkyl and/or aromatic groups (see, for example, U.S. Patent Application No. 2007/0099103, the disclosure of which is hereby incorporated by reference in its entirety); organometallic complexes of dimethyl sulfoxide with metal salts (see, for example, U.S. Patent Application No. 2006/0188801, the disclosure of which is hereby incorporated by reference in its entirety); calcium salts of organic acid compounds having one or more acid groups including carboxyl groups, sulfonic groups and/or hydroxyl groups (see, for example, U.S. Pat. No. 6,977,129, the disclosure of which is hereby incorporated by reference in its entirety); barium salts of sulfoisophthalic acid compounds (see, for example, U.S. Pat. No. 6,830,859, the disclosure of which is hereby incorporated by reference in its entirety); polyhydroxyalkanoates including substituted phenyl units (see, for example, U.S. Pat. No. 6,908,720, the disclosure of which is hereby incorporated by reference in its entirety); acetamides including N-substituted 2-(1,2-benzisothiazol-3(2H)-ylidene 1,1-dioxide)acetamide (see, for example, U.S. Pat. No. 6,184,387, the disclosure of which is hereby incorporated by reference in its entirety); benzenesulfonamides, including N-(2-(1,2-benzisothiazol-3(2H)-ylidene 1,1-dioxide)-2-cyanoacetyl)benzenesulfonamide (see, for example, U.S. Pat. No. 6,165,668, the disclosure of which is hereby incorporated by reference in its entirety); combinations thereof, and the like.

In embodiments, a suitable CCA includes an aluminum complex of 3,5-di-tert-butylsalicylic acid in powder form, commercially available as BONTRON E-88™ (from Orient chemical). This CCA is depicted as set forth in Formula III below:

(III)

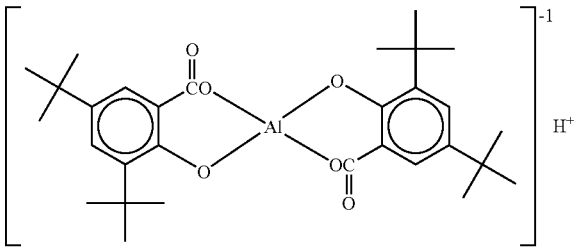

Other suitable CCAs include, for example, BONTRON E-84™ (commercially available from Orient chemical), which is a zinc complex of 3,5-di-tert-butylsalicylic acid in powder form (BONTRON E-84™ is similar to BONTRON E-88™ as depicted in Formula III above, except zinc is the counter ion instead of aluminum.

The emulsion including the resin and CCA may be prepared utilizing any method within the purview of those skilled in the art. In embodiments, the CCA and resin may be combined utilizing a solvent flash method, a solventless emulsification method, or a phase inversion method. Examples of the solvent flash methods include those disclosed in U.S. Pat. No. 7,029,817, the disclosure of which is hereby incorporated by reference in its entirety. Examples of solventless emulsification methods include those disclosed in U.S. patent application Ser. No. 12/032,173 filed Feb. 15, 2008, the disclosure of which is hereby incorporated by reference in its entirety. Examples of a suitable phase inversion method include those disclosed in U.S. Patent Application Publication No. 2007/0141494, the disclosure of which is hereby incorporated by reference in its entirety. In further embodiments, the CCA and resin may be combined using a solvent emulsification method, wherein the CCA and resin are dissolved in an organic solvent, followed by introducing the above solution in deionized water under homogenization.

The shell resin and CCA may be applied to the aggregated particles by any method within the purview of those skilled in the art. In embodiments, the polyester resin utilized to form the shell in combination with the CCA may be in a surfactant described above as an emulsion. The emulsion possessing the polyester resin and CCA may be combined with the aggregated particles described above so that the shell forms over the aggregated particles. Where the resin and CCA are in an emulsion, the emulsion may possess from about 1 percent solids by weight of the emulsion to about 80 percent solids by weight of the emulsion, in embodiments from about 5 percent solids by weight of the emulsion to about 60 percent solids by weight of the emulsion.

In embodiments, the resulting emulsion utilized to form the shell may include a charge control agent in an amount of from about 0.1 percent by weight of the emulsion to about 20 percent by weight of the emulsion, in embodiments from about 0.5 percent by weight of the emulsion to about 10 percent by weight of the emulsion, and the at least one polyester resin latex in an amount of from about 80 percent by weight of the emulsion to about 99.9 percent by weight of the emulsion, in embodiments from about 90 percent by weight of the emulsion to about 99.5 percent by weight of the emulsion.

The resulting shell may thus include the charge control agent in an amount of from about 0.1 percent by weight of the shell to about 20 percent by weight of the shell, in embodiments from about 0.5 percent by weight of the shell to about 5 percent by weight of the shell, and the at least one polyester resin latex in an amount of from about 80 percent by weight of the shell to about 99.9 percent by weight of the shell, in embodiments from about 90 percent by weight of the shell to about 99.5 percent by weight of the shell.

The formation of the shell over the aggregated particles may occur while heating to an elevated temperature in embodiments from about 35° C. to about 99° C., in embodiments from about 40° C. to about 80° C. The formation of the shell may take place for a period of time of from about 1 minute to about 5 hours, in embodiments from about 5 minutes to about 3 hours.

Utilizing the resin/CCA combination to form a shell provides the resulting toner particles with desirable charging characteristics and desirable sensitivity to relative humidity, while preventing the crystalline polyester from migrating to the surface of the toner particles.

Through the processes of the present disclosure, most CCAs can be incorporated in an EA Ultra Low Melt toner. Furthermore, compared to conventional processes which melt mix CCAs with toner resins and other components, the amount of CCAs needed in accordance with the present disclosure may be reduced since they only need to be added to the toner shell. Moreover, charging, relative humidity (RH) sensitivity, and parent toner flow performance may be improved compared with conventional toners.

In embodiments, the toner core may have a size from about 2 microns to about 8.5 microns, in embodiments from about 2.5 microns to about 7.5 microns, and in embodiments from about 3 microns to about 5.5 microns. The toner shell may have a thickness from about 100 nm to about 3 microns, in embodiments from about 500 nm to about 2 microns. The volume percentage of the shell may be, for example, from about 15 percent to about 50 percent of the toner, in embodiments from about 20 percent to about 40 percent of the toner, in embodiments from about 25 percent to about 30 percent of the toner.

In embodiments, the toner may include a core/shell structure, with the shell including a CCA. In other embodiments, the toner may include a core/shell structure, with the shell including a CCA, but no CCA in the core.

Incorporation of a CCA in only the shell portion of the toner can therefore reduce the amount of CCA required while achieving the same or even better charging results. Compared to conventional approaches where the CCA is homogeneously distributed in the toner, the approach of the present disclosure can reduce the amount of CCA by, for example, from about 50 percent to about 85 percent, in embodiments from about 60 percent to about 80 percent, and in embodiments from about 70 percent to about 75 percent.

Coalescence

Following aggregation to the desired particle size and application of the shell resin described above, the particles may then be coalesced to the desired final shape, the coalescence being achieved by, for example, heating the mixture to a suitable temperature. This temperature may, in embodiments, be from about 0° C. to about 50° C. higher than the onset melting point of the crystalline polyester resin utilized in the core, in other embodiments from about 5° C. to about 30° C. higher than the onset melting point of the crystalline polyester resin utilized in the core. For example, by utilizing the polyester gel in forming a shell as described above, in embodiments the temperature for coalescence may be from about 40° C. to about 99° C., in embodiments from about 50° C. to about 95° C. Higher or lower temperatures may be used, it being understood that the temperature is a function of the resins used.

Coalescence may also be carried out with stirring, for example at a speed of from about 50 rpm to about 1,000 rpm, in embodiments from about 100 rpm to about 600 rpm. Coalescence may be accomplished over a period of from about 1 minute to about 24 hours, in embodiments from about 5 minutes to about 10 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

The shell resin may be able to prevent any crystalline resin in the core from migrating to the toner surface. In addition, the shell resin may be less compatible with the crystalline resin utilized in forming the core, which may result in a higher toner glass transition temperature (Tg). For example, toner particles having a shell of the present disclosure may have a glass transition temperature of from about 30° C. to about 80° C., in embodiments from about 35° C. to about 70° C. This higher Tg may, in embodiments, improve blocking and charging characteristics of the toner particles, including A-zone charging.

The presence of the CCA in the shell may also improve blocking and charging characteristics of the toner particles, including A-zone charging, as well as relative humidity sensitivity and cohesiveness.

In embodiments, the polyester resin utilized to form the shell may be present in an amount of from about 2 percent by weight to about 40 percent by weight of the dry toner particles, in embodiments from about 5 percent by weight to about 35 percent by weight of the dry toner particles.

Additives

In embodiments, the toner particles may also contain other optional additives, as desired or required. For example, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, 6,214,507, and 7,452,646 the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a shell of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.93 to about 1, in embodiments from about 0.95 to about 0.99 (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may possess A zone charging of from about −3 μC/g to about −60 μC/g, in embodiments from about −4 μC/g to about −50 μC/g, a parent toner charge per mass ratio (Q/M) of from about −3 μC/g to about −60 μC/g, in embodiments from about −4 μC/g to about −50 μC/g, and a final triboelectric charge of from −4 μC/g to about −50 μC/g, in embodiments from about −5 μC/g to about −40 μC/g.

In accordance with the present disclosure, the charging of the toner particles may be enhanced, so less surface additives may be required, and the final toner charging may thus be higher to meet machine charging requirements.

Developers

The toner particles thus obtained may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be affected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Comparative Example 1

Preparation of a polystyrene-acrylate gel latex. A latex emulsion including polymer gel particles generated from the semi-continuous emulsion polymerization of styrene, n-butyl acrylate, divinylbenzene, and beta-carboxyethyl acrylate (Beta-CEA) was prepared as follows.

A surfactant solution including about 1.75 kilograms Neogen RK (anionic emulsifier) and about 145.8 kilograms de-ionized water was prepared by mixing for 10 minutes in a stainless steel holding tank. The holding tank was then purged with nitrogen for about 5 minutes before transferring into the reactor. The reactor was then continuously purged with nitrogen while being stirred at about 300 revolutions per minute (rpm). The reactor was then heated up to about 76° C. at a controlled rate and held constant.

In a separate container, about 1.24 kilograms of ammonium persulfate initiator was dissolved in about 13.12 kilograms of de-ionized water.

Also in a second separate container, a monomer emulsion was prepared in the following manner. About 47.39 kilograms of styrene, about 25.52 kilograms of Neogen RK (anionic surfactant), and about 78.73 kilograms of de-ionized water were mixed to form an emulsion. The ratio of styrene monomer to n-butyl acrylate monomer was about 65 to about 35 percent by weight. One percent of the above emulsion was then slowly fed into the reactor containing the aqueous surfactant phase at about 76° C. to form "seeds" while being purged with nitrogen. The initiator solution was then slowly charged into the reactor and after about 20 minutes the rest of the emulsion was continuously fed in using metering pumps.

Once all the monomer emulsion was charged into the main reactor, the temperature was held at about 76° C. for an additional 2 hours to complete the reaction. Full cooling was then applied and the reactor temperature was reduced to about 35° C. The product was collected into a holding tank after filtration through a 1 micron filter bag. After drying a portion of the latex, the molecular properties were measured. The Mw was about 134,700, Mn was about 27,300, and the onset Tg was about 43° C. The average particle size of the latex as measured by Disc Centrifuge was about 48 nanometers and residual monomer as measured by gas chromatography (GC) was <50 ppm for styrene and <100 ppm for n-butyl acrylate.

About 138.76 grams of a linear amorphous resin in an emulsion (about 43.45 weight % resin) was added to a 2 liter beaker. The linear amorphous resin was of the following formula:

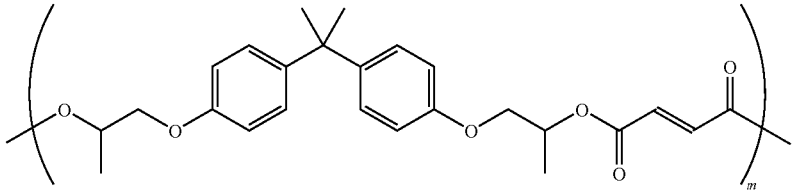

(I)

wherein m was from about 5 to about 1000, and was produced following the procedures described in U.S. Pat. No. 6,063,827, the disclosure of which is hereby incorporated by reference in its entirety. About 48.39 grams of an unsaturated crystalline polyester ("UCPE") resin composed of ethylene glycol and a mixture of dodecanedioic acid and fumaric acid co-monomers with the following formula:

(II)

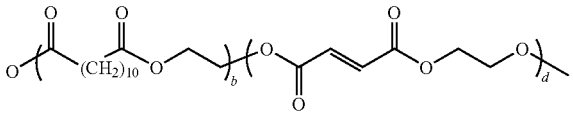

wherein b was from about 5 to about 2000 and d was from about 5 to about 2000, in an emulsion (about 29.76 weight % resin), synthesized following the procedures described in U.S. Patent Application Publication No. 2006/0222991, the disclosure of which is hereby incorporated by reference in its entirety, with about 16.4 grams of the gel resin in an emulsion as produced in Comparative Example 1 above (about 43.6 weight % resin), about 28.53 grams of a cyan pigment, Pigment Blue 15:3 (about 17.42 wt %), and about 549.71 grams of deionized water, were added to the beaker. About 35.84 grams of $Al_2(SO_4)_3$ (about 1 weight %) was added as a flocculent under homogenization by mixing at a speed of from about 3000 rpm to about 4000 rpm.

The mixture was subsequently transferred to a 2 liter Buchi reactor, and heated to about 44.5° C. for aggregation while mixing at a speed of about 700 rpm. The particle size was monitored with a Coulter Counter until the core particles reached a volume average particle size of about 6.82 μm with a Geometric Size Distribution ("GSD") of about 1.22.

About 77.72 grams of the above emulsion with the resin of formula I was added to the particles to form a shell thereover, resulting in particles possessing a core/shell structure having an average particle size of about 9.05 μm, and a GSD of about 1.2.

Thereafter, the pH of the reaction slurry was increased to about 7.5 by adding NaOH to freeze, that is stop, the toner growth. After stopping the toner growth, the reaction mixture was heated to about 69° C. and kept at that temperature for about 0.5 hours for coalescence.

The resulting toner particles had a final average volume particle size of about 8.41 μm, a GSD of about 1.24, and a circularity of about 0.963.

The toner slurry was then cooled to room temperature, separated by sieving (utilizing a 25 μm sieve), and filtered, followed by washing and freeze drying.

Example 1

An emulsion including about 1% of a charge control agent with an amorphous resin was prepared as follows. About 125 grams of the amorphous resin of formula I in Comparative Example 1 above, and about 1.25 grams of a zinc complex of 3,5-di-tert-butylsalicylic acid in powder form as a charge control agent (commercially available as BONTRON E-84™ from Orient Chemical) were measured into a 2 liter beaker containing about 900 grams of ethyl acetate. The mixture was stirred at about 300 revolutions per minute at room temperature to dissolve the resin and CCA in the ethyl acetate.

About 3.55 grams of sodium bicarbonate and about 2.74 grams of DOWFAX™ 2A1, an alkyldiphenyloxide disulfonate (from The Dow Chemical Company, Midland, Mich.), were measured into a 4 liter Pyrex glass flask reactor containing about 700 grains of deionized water and heated to about 65° C. Homogenization of this heated water solution in the 4 liter glass flask reactor occurred utilizing an IKA Ultra Turrax T50 homogenizer at about 4,000 revolutions per minute. The heated resin and CCA solution was then slowly poured into the water solution over a period of about 0.1 minutes. The homogenizer speed was increased to about 8,000 revolutions per minute and homogenization continued for about 30 minutes. Upon completion of homogenization, the glass flask reactor and its contents were placed in a heating mantle and connected to a distillation device. The mixture was stirred at about 275 revolutions per minute and the temperature of the mixture was increased to about 80° C. at about 1° C. per minute to distill off the ethyl acetate from the mixture. Stirring continued at about 80° C. for about 120 minutes followed by cooling at a rate of about 2° C. per minute until the mixture was at room temperature.

The product was screened through a 25 micron sieve. The resulting resin emulsion included about 19.16% by weight solids in water, and had a volume average diameter of about 129.9 nanometers as measured with a HONEYWELL MICROTRAC® UPA150 particle size analyzer.

Example 2

Toner particles were then prepared with the emulsion from Example 1 as a shell. The amount of CCA in the toner particles, based upon the total weight of the dry toner, was about 0.28% by weight.

About 138.76 grams of the linear amorphous resin of formula I in Comparative Example 1 above, in an emulsion (about 43.45 weight % resin), about 48.39 grams of the crystalline resin of formula II in Comparative Example 1 above, in an emulsion (about 29.76 weight % resin), about 16.4 grams of the gel resin in Comparative Example 1 above (about 43.6 weight % resin), about 28.53 grains of a cyan pigment, Pigment Blue 15:3 (about 17.42 wt %), and about 549.71 grams of deionized water were added to a 2 liter beaker. About 35.84 grams of $Al_2(SO_4)_3$ (about 1 weight %) was added as a flocculent under homogenization by mixing at a speed of from about 3000 rpm to about 4000 rpm.

The mixture was subsequently transferred to a 2 liter Buchi reactor, and heated to about 44.5° C. for aggregation while mixing at a speed of about 700 rpm. The particle size was monitored with a Coulter Counter until the core particles reached a volume average particle size of about 6.82 μm with a Geometric Size Distribution ("GSD") of about 1.22.

About 176.24 grams of the emulsion from Example 1, including the amorphous resin (about 19.16 weight % resin) and about 1% BONTRON E-84™ CCA was added to form a shell, resulting in core/shell structured particles having an average particle size of about 8.41 μm, and a GSD of about 1.21.

Thereafter, the pH of the reaction slurry was increased to about 7.5 by adding NaOH to freeze, that is stop, the toner growth. After stopping the toner growth, the reaction mixture was heated to about 70° C. and kept at that temperature for about 60 hours for coalescence.

The resulting toner particles had a final average volume particle size of about 8.41 μm, and a GSD of about 1.23.

The toner slurry was then cooled to room temperature, separated by sieving (utilizing a 25 μm sieve), and filtered, followed by washing and freeze drying.

Example 3

An emulsion including about 10% of a charge control agent with an amorphous resin was prepared following the procedures set forth in Example 1 above, except about 12.5 grams of BONTRON E-84™ were added to the emulsion (some of the BONTRON E-84™ was not incorporated into the emulsion).

Example 4

Toner particles were then prepared with the emulsion from Example 3 as a shell. The amount of CCA in the toner particles, based upon the total weight of the dry toner, was about 2.8% by weight.

About 138.76 grams of the linear amorphous resin of formula I in Comparative Example 1 above, in an emulsion (about 43.45 weight % resin), about 48.39 grams of the crystalline resin of formula II in Comparative Example 1 above, in an emulsion (about 29.76 weight % resin), about 16.4 grams of the gel resin in Comparative Example 1 above (about 43.6 weight % resin), about 28.53 grams of a cyan pigment, Pigment Blue 15:3 (about 17.42 wt %), and about 549.71 grams of deionized water were added to a 2 liter beaker. About 35.84 grams of $Al_2(SO_4)_3$ (about 1 weight %) was added as a flocculent under homogenization by mixing at a speed of from about 3000 rpm to about 4000 rpm.

The mixture was subsequently transferred to a 2 liter Buchi reactor, and heated to about 44.5° C. for aggregation while mixing at a speed of about 700 rpm. The particle size was monitored with a Coulter Counter until the core particles reached a volume average particle size of about 6.82 μm with a Geometric Size Distribution ("GSD") of about 1.22.

About 160.57 grams of the emulsion from Example 3, including the amorphous resin (about 21.03 weight % resin) and about 10% BONTRON E-84™ CCA, was added to form a shell, resulting in core/shell structured particles having an average particle size of about 9.24 μm, and a GSD of about 1.21.

Thereafter, the pH of the reaction slurry was increased to about 7.5 by adding NaOH to freeze, that is stop, the toner growth. After stopping the toner growth, the reaction mixture was heated to about 70° C. and kept at that temperature for about 60 hours for coalescence.

The resulting toner particles had a final average volume particle size of about 9.64 μm, and a GSD of about 1.23.

The toner slurry was then cooled to room temperature, separated by sieving (utilizing a 25 μm sieve), and filtered, followed by washing and freeze drying.

Example 5

An emulsion including about 1% of a charge control agent with an amorphous resin was prepared following the procedures set forth in Example 1 above, except about 1.25 grams of an aluminum complex of 3,5-di-tert-butylsalicylic acid in powder form (commercially available as BONTRON E-88™ from Orient Chemicals) was added to the emulsion as the CCA. An emulsion having particle sizes of about 127 nm was obtained.

Example 6

Toner particles were then prepared with the emulsion from Example 5 as a shell. The amount of CCA in the toner particles, based upon the total weight of the dry toner, was about 0.28% by weight.

About 138.76 grams of the linear amorphous resin of formula I in Comparative Example 1 above, in an emulsion (about 43.45 weight % resin), about 48.39 grams of the crystalline resin of formula II in Comparative Example 1 above, in an emulsion (about 29.76 weight % resin), about 16.4 grams of the gel resin in Comparative Example 1 above (about 43.6 weight % resin), about 28.53 grams of a cyan pigment, Pigment Blue 15:3 (about 17.42 wt %), and about 549.71 grams of deionized water were added to a 2 liter beaker. About 35.84 grams of $Al_2(SO_4)_3$ (about 1 weight %) was added as a flocculent under homogenization by mixing at a speed of from about 3000 rpm to about 4000 rpm.

The mixture was subsequently transferred to a 2 liter Buchi reactor, and heated to about 49.2° C. for aggregation while mixing at a speed of about 700 rpm. The particle size was monitored with a Coulter Counter until the core particles reached a volume average particle size of about 6.68 μm with a Geometric Size Distribution ("GSD") of about 1.24.

About 169.52 grams of the emulsion from Example 5, including the amorphous resin (about 19.92 weight % resin) and about 1% BONTRON E-88™ CCA, was added to form a shell, resulting in core/shell structured particles having an average particle size of about 9.24 μm, and a GSD of about 1.21.

Thereafter, the pH of the reaction slurry was increased to about 7.5 by adding NaOH to freeze, that is stop, the toner growth. After stopping the toner growth, the reaction mixture was heated to about 70° C. and kept at that temperature for about 60 hours for coalescence.

The resulting toner particles had a final average volume particle size of about 8.77 μm, and a GSD of about 1.25.

The toner slurry was then cooled to room temperature, separated by sieving (utilizing a 25 μm sieve), and filtered, followed by washing and freeze drying.

The toners of the above Examples were analyzed for metal content using Inductively Coupled Plasma (ICP). ICP is an analytical technique used for the detection of trace metals in an aqueous solution. The primary goal of ICP is to get elements to emit characteristic wavelength specific light that can then be measured. The light emitted by the atoms of an element in the ICP must be converted to an electrical signal that can be measured quantitatively. This is accomplished by resolving the light into its component radiation (nearly always by means of a diffraction grating) and then measuring the light intensity with a photomultiplier tube at the specific wavelength for each element line. The light emitted by the atoms or ions in the ICP is converted to electrical signals by the photomultiplier in the spectrometer. The intensity of the electron signal is compared to previous measured intensities of known concentrations of the element, and a concentration is computed. Each element will have many specific wavelengths in the spectrum that could be used for analysis.

Utilizing ICP, for the control toner of Comparative Example 1 above, about 473 ppm of aluminum was found, which came from the aggregating agent, $Al_2(SO_4)_3$, and no zinc was detected. For the toner of Example 2, about 244 ppm of zinc was detected, which was from the 1% BONTRON E-84™. For the toner of Example 4, about 1990 ppm of zinc was detected, which was from the 10% BONTRON E-84™. That the zinc detected in the toner of Example 4 was not 10 times the zinc detected in the toner of Example 2 is consistent with the observation that not all of the BONTRON E-84™ was incorporated into the emulsion.

For the toner of Example 6, about 100 ppm more aluminum was detected than in the other toners, which was from the aluminum in the BONTRON E-88™. A summary of the zinc and aluminum concentrations for these toners is set forth below in Table 1.

TABLE 1

Zn and Al concentration in toner as measured by ICP

| | Al concentration in toner (ppm) | Zn concentration in toner (ppm) |
|---|---|---|
| Toner of Comparative Example 1 | 473.1 | <10 |
| Toner of Example 2 | 458 | 244 |
| Toner of Example 4 | 463 | 1990 |
| Toner of Example 6 | 567 | <10 |

Charging characteristics of the toners of the present disclosure with the CCA in the shell resin, and the toner of Comparative Example 1, were also determined by a total blow-off apparatus also known as a Barbetta box. Developers were conditioned overnight in A and C zones and then charged using a paint shaker for from about 5 minutes to about 60 minutes to provide information about developer stability with time and between zones. The low-humidity zone (C zone) was about 10° C./15% RH, while the high humidity zone (A zone) was about 28° C./85% RH. Toners of the present disclosure exhibited a parent toner charge per mass ratio (Q/M) of from about −3 μC/g to about −60 μC/g.

The results obtained from this charging test are set forth in FIG. 1, which compares the charging of the toner of Comparative Example 1 (no CCA in the shell), with the toners of the Examples, including those having in their shell 1% BONTRON E-84™ (Example 2), 10% BONTRON E-84™ (Example 4), and 1% BONTRON E-88™ (Example 6). (In FIG. 1, Q/m is charge, AZ is A-zone, CZ is C-zone, 5M is 5 minutes, and 60 M is 60 minutes).

As can be seen in FIG. 1, the addition of CCA in the EA ULM toner shell had a very beneficial effect on charging in both the A-zone and C-zone, especially in the C-zone. Small amounts of CCA in the shell increase C-zone charging much more than in the A-zone. However, adding more CCA in the co-emulsification step resulted in the extraordinary effect of moving the A-zone charging to a higher level without increasing the C-zone charging, as can be seen in FIG. 1. At 10% BONTRON E-84™ loading, (based on toner shell component, 2.8% based on total toner) the C-zone charging was comparable to the 1% CCA amount. In addition, both A-zone and C-zone charging increased with charging time, which is contrary to the behavior observed with conventional toners, which frequently demonstrate a drop in A-zone charging with charging time. (Such a drop in charging is undesirable, as it can reduce developability during printing).

Figure 2:
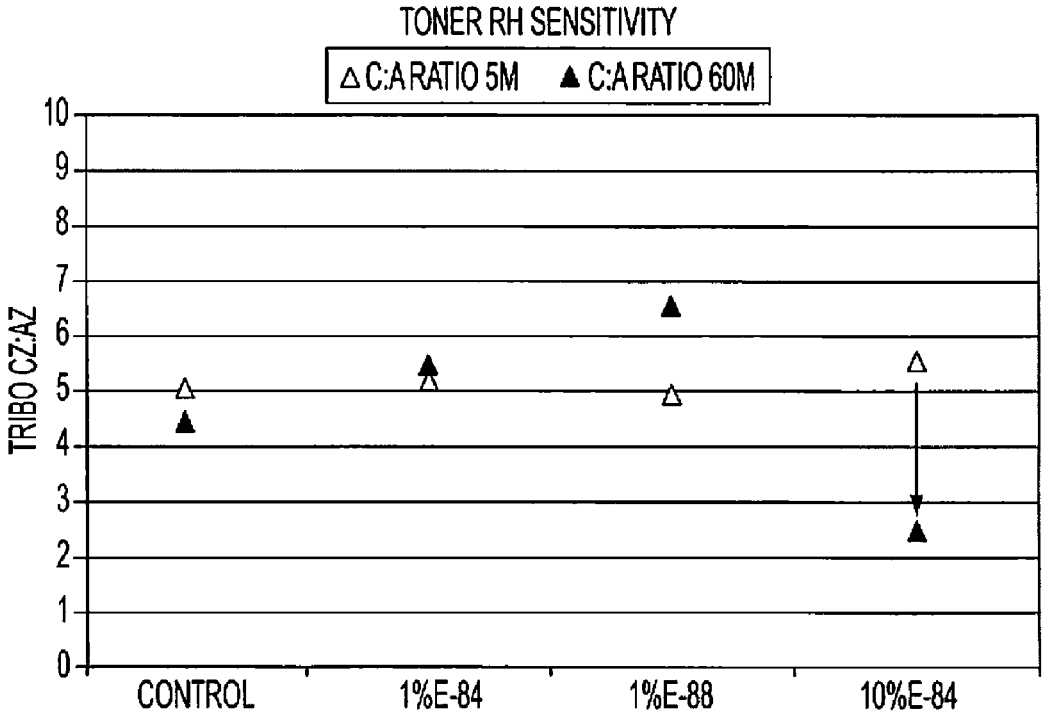
FIG. 2 is a graph comparing the relative humidity (RH) sensitivity of toners of the present disclosure, possessing charge control agents in the shell, with a control toner.

As would be appreciated by one skilled in the art, the amount and the type of CCA added to the shell resin is very important with respect to toner RH sensitivity. The relative humidity sensitivity of the toners produced in these Examples was determined as a ratio of C-zone charging to A-zone charging. The results are set forth in FIG. 2, which compares the RH sensitivity of the toner of Comparative Example 1 (no CCA in the shell), with the toners of the Examples, including those having in their shell 1% BONTRON E-84™ (Example 2), 10% BONTRON E-84™ (Example 4), and 1% BONTRON E-84™ (Example 6). Parent toner RH sensitivity is related to the final cost of the toner, which can be reduced if the total surface additives are reduced. In FIG. 2, the lower the number the better.

The toners were also tested for cohesivity. The greater the cohesivity, the less the toner particles are able to flow. Cohesivity may be determined utilizing methods within the purview of those skilled in the art, in embodiments by placing a known mass of toner, for example two grams, on top of a set of about three screens, for example with screen meshes of about 53 microns, about 45 microns, and about 38 microns, in order from top to bottom, and vibrating the screens and toner for a fixed time at a fixed vibration amplitude, for example for about 115 seconds at about a 1 millimeter vibration amplitude. A device which may be utilized to perform this measurement includes the Hosokawa Powders Tester, commercially available from Micron Powders Systems. The toner cohesion value is related to the amount of toner remaining on each of the screens at the end of the time. A cohesion value of 100% corresponds to all of the toner remaining on the top screen at the end of the vibration step and a cohesion value of zero corresponds to all of the toner passing through all three screens, that is, no toner remaining on any of the three screens at the end of the vibration step. The higher the cohesion value, the lower the flowability of the toner.

Figure 3:
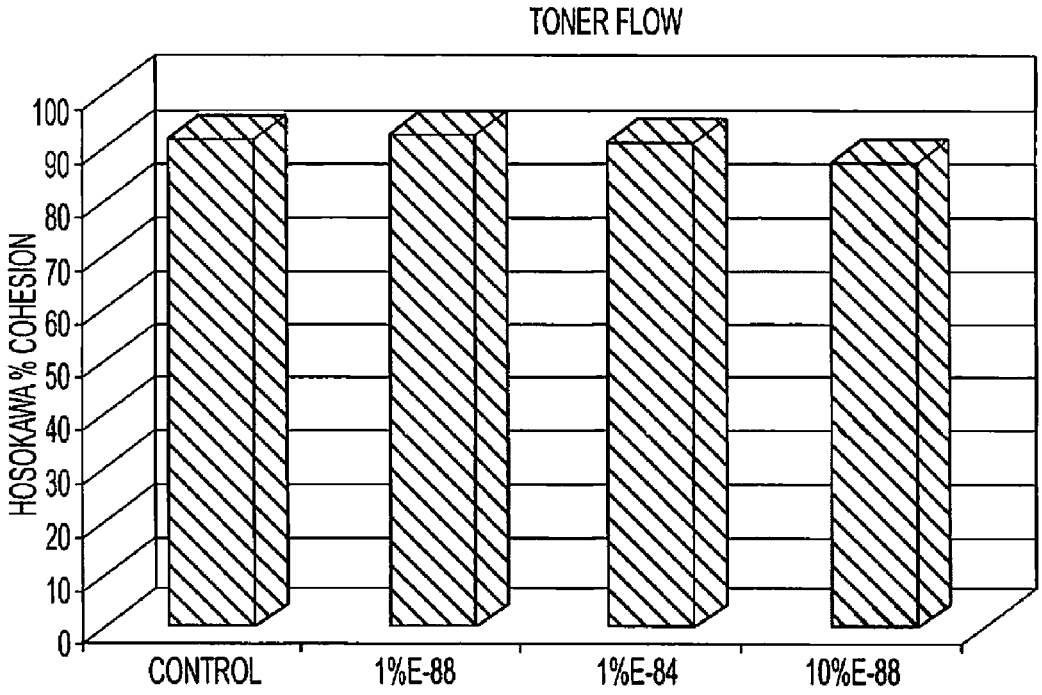
FIG. 3 is a graph comparing the cohesivity of toners of the present disclosure, possessing charge control agents in the shell, with a control toner.

The results of this cohesivity testing are set forth in FIG. 3. As is seen in FIG. 3, the addition of 10% BONTRON E-84™ in the toner shell decreased toner cohesivity, allowing the parent toner to flow more easily.

To summarize, charging, RH sensitivity and parent toner flow performance of EA ULM toners was significantly improved by the incorporation of CCA in the toner shell emulsion by co-emulsifying the CCA with an amorphous resin. Utilizing these methods, the majority of CCAs commercially available can be incorporated in an emulsion aggregation toner, while avoiding problems that may arise in dispersing a CCA in an aqueous solution.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a core comprising at least one amorphous resin, at least one crystalline resin, and one or more optional ingredients selected from the group consisting of optional colorants, optional waxes, and combinations thereof; and a shell comprising at least one charge control agent selected from the group consisting of alkyl pyridinium halides, bisulfates, organic sulfates, organic sulfonates, cetyl pyridinium tetrafluoroborates, distearyl dimethyl ammonium methyl sulfate, aluminum salts, zinc salts, azo-metal complexes, amorphous metal complex salt compounds, carboxylic acids, substituted carboxylic acids, metal complexes of carboxylic acids, nitroimidazole derivatives, calixarene compounds, sulfonates, styrene-acrylate-based copolymers with sulfonate groups, styrene-methacrylate-based copolymers with sulfonate groups, and combinations thereof, co-emulsified with at least one amorphous shell resin.

2. The toner composition of claim 1, wherein the charge control agent is present in an amount of from about 0.1 percent by weight to about 20 percent by weight of the shell, and the at least one amorphous shell resin is present in an amount of from about 80 percent by weight to about 99.9 percent by weight of the shell.

3. The toner according to claim 1, wherein the at least one amorphous resin of the core comprises a polyester selected from the group consisting of poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and wherein the at least one crystalline resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly (hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly (5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly (hexylene-adipate), alkali copoly(5-sulfo-isophthaloyl)-copoly(octylene-adipate), alkali copoly(5-sulfoisophthaloyl)-copoly(ethylene-succinate), alkali copoly (5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly (ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), and poly(octylene-adipate), wherein alkali comprises a metal selected from the group consisting of sodium, lithium and potassium.

4. The toner according to claim 1, wherein the amorphous resin of the shell is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, wherein the colorant comprises dyes, pigments, combinations of dyes, combinations of pigments, and combinations of dyes and pigments, present in an amount of from about 0.1 to about 35 percent by weight of the toner, and wherein the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

5. The toner according to claim 1, wherein the charge control agent is selected from the group consisting of aluminum complexes of 3,5-di-tert-butylsalicylic acid, zinc complexes of 3,5-di-tert-butylsalicylic acid, and combinations thereof, and wherein the toner particles are of a size of from about 3 to about 25 μm, possess a circularity of from about 0.93 to about 1, and possess a parent toner charge per mass ratio of from about −3 μC/g to about −60 μC/g.

6. A process of making the toner of claim 1 comprising:

contacting at least one amorphous resin with an optional crystalline resin in a dispersion form;

contacting the dispersion with an optional colorant, at least one surfactant, and an optional wax to form small particles;

aggregating the small particles to form a core;

contacting the small particles with an emulsion comprising at least one charge control agent in combination with at least one amorphous resin to form a shell over the small particles;

coalescing the small particles possessing the shell to form toner particles; and recovering the toner particles.

7. The process according to claim 6, wherein the amorphous resin of the core is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

8. The process according to claim 6, wherein the optional crystalline resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly (pentylene-sebacate), poly(hexylene-sebacate), poly(octylene-sebacate), alkali copoly(5-sulfoisophthaloyl)-copoly (ethylene-adipate), alkali copoly(5-sulfoisophthaloyl)-copoly(propylene-adipate), alkali copoly(5-sulfoisophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly (5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly (octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly (5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), and poly(octylene-adipate), wherein alkali comprises a metal selected from the group consisting of sodium, lithium and potassium.

9. The process according to claim 6, wherein the amorphous resin of the shell is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

10. The process according to claim 6, wherein the charge control agent is selected from the group consisting of alkyl pyridinium halides, bisulfates, organic sulfates, organic sulfonates, cetyl pyridinium tetrafluoroborates, distearyl dimethyl ammonium methyl sulfate, aluminum salts, zinc salts, azo-metal complexes, amorphous metal complex salt compounds, carboxylic acids, substituted carboxylic acids, metal complexes of carboxylic acids, nitroimidazole derivatives, calixarene compounds, sulfonates, styrene-acrylate-based copolymers with sulfonate groups, styrene-methacrylate-based copolymers with sulfonate groups, and combinations thereof.

11. The process according to claim 6, wherein the charge control agent is selected from the group consisting of aluminum complexes of 3,5-di-tert-butylsalicylic acid, zinc complexes of 3,5-di-tert-butylsalicylic acid, and combinations thereof.

12. The process according to claim 6, wherein the emulsion comprising the at least one charge control agent in combination with at least one amorphous resin is prepared by a method selected from the group consisting of solvent flash methods, phase inversion methods, and solventless emulsification methods.

13. The process according to claim 6, wherein the emulsion utilized to form the shell comprises the charge control agent in an amount of from about 0.1 to about 20 percent by weight of the emulsion, and the at least one amorphous resin in an amount of from about 80 to about 99.9 percent by weight of the emulsion.

14. The process according to claim 6, wherein the optional colorant comprises dyes, pigments, combinations of dyes, combinations of pigments, and combinations of dyes and pigments in an amount of from about 0.1 to about 35 percent by weight of the toner, and the optional wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

15. The process according to claim 6, wherein the toner particles possess a volume average diameter of from about 3 to about 25 μm, possess a circularity of from about 0.93 to about 1, and possess a parent toner charge per mass ratio of from about −3 μC/g to about −60 μC/g.

16. A process of making the toner of claim 1 comprising:

contacting at least one amorphous resin with an optional crystalline resin in a dispersion;

contacting the dispersion with an optional colorant, at least one surfactant, and an optional wax to form small particles;

aggregating the small particles to form a core;

contacting the small particles with an emulsion comprising at least one charge control agent in combination with at least one amorphous resin to form a shell over the small particles;

coalescing the small particles possessing the shell to form toner particles; and recovering the toner particles, wherein the emulsion comprising the at least one charge control agent in combination with at least one polyester resin is prepared by a method selected from the group consisting of solvent flash methods, phase inversion methods, and solvent less emulsification methods.

17. The process according to claim 16, wherein the amorphous resin of the core is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and the at least one crystalline resin comprises a polyester selected from the group consisting of poly(ethylene-adipate), poly(propylene-adipate), poly (butylene-adipate), poly(pentylene-adipate), poly(hexylene-adipate), poly(octylene-adipate), poly(ethylene-succinate), poly(propylene-succinate), poly(butylene-succinate), poly (pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly (hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly (propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), and poly(octylene-adipate), wherein alkali comprises a metal selected from the group consisting of sodium, lithium and potassium.

18. The process according to claim 16, wherein the charge control agent is selected from the group consisting of alkyl pyridinium halides, bisulfates, organic sulfates, organic sulfonates, cetyl pyridinium tetrafluoroborates, distearyl dimethyl ammonium methyl sulfate, aluminum salts, zinc salts, azo-metal complexes, amorphous metal complex salt compounds, carboxylic acids, substituted carboxylic acids, metal complexes of carboxylic acids, nitroimidazole derivatives, calixarene compounds, sulfonates, styrene-acrylate-based copolymers with sulfonate groups, styrene-methacrylate-based copolymers with sulfonate groups, and combinations thereof.

19. The process according to claim 16, wherein the charge control agent is selected from the group consisting of aluminum complexes of 3,5-di-tert-butylsalicylic acid, zinc complexes of 3,5-di-tert-butylsalicylic acid, and combinations thereof.

20. The process according to claim 16, wherein the emulsion utilized to form the shell comprises the charge control agent in an amount of from about 0.1 to about 20 percent by weight of the emulsion, and the at least one amorphous resin in an amount of from about 80 to about 99.9 percent by weight of the emulsion, and wherein the toner particles are of a size of from about 3 to about 25 μm, possess a circularity of from about 0.93 to about 1, and possess a parent toner charge per mass ratio of from about −3 μC/g to about −60 μC/g.

* * * * *